United States Patent [19]

Donnelli et al.

[11] 4,113,109

[45] Sep. 12, 1978

[54] MERCHANDISING SYSTEM FOR USE WITH PERFORATED PANELS OR THE LIKE

[75] Inventors: Joseph W. Donnelli; Richard D. Barnes, both of Rockford, Ill.

[73] Assignee: Southern Imperial, Inc., Tupelo, Miss.

[21] Appl. No.: 821,809

[22] Filed: Aug. 4, 1977

[51] Int. Cl.[2] ..... A47F 7/00; A47G 29/00

[52] U.S. Cl. ..... 211/49 R; 206/806; 248/205 R; 248/221.1; 248/360

[58] Field of Search ..... 248/359, 360, 220.3–221.2, 248/223.4–224.2, 205 R; 206/806, 820; 211/49–59, 194, 188

[56] References Cited

U.S. PATENT DOCUMENTS

| | | | |
|---|---|---|---|
| 409,152 | 8/1889 | Kinney | 248/360 |
| 2,273,641 | 2/1942 | Henderson | 248/360 |
| 2,283,546 | 5/1942 | Fischer | 211/55 X |
| 2,909,287 | 10/1959 | Galassi | 211/55 |
| 3,795,380 | 3/1974 | Turner | 248/224.2 X |
| 3,999,821 | 12/1976 | Moody et al. | 211/59.1 X |

*Primary Examiner*—Roy D. Frazier
*Assistant Examiner*—Terrell P. Lewis
*Attorney, Agent, or Firm*—Leydig, Voit, Osann, Mayer & Holt, Ltd.

[57] ABSTRACT

The upper ends of display packages are formed with hooks and notches which enable a first package to hang either directly or substantially directly from a perforated panel and to enable each succeeding package to hang directly from and in front of the immediately preceding package so that a series of packages may be hung in a forwardly extending row without need of a forwardly projecting hook for supporting the packages.

16 Claims, 13 Drawing Figures

MERCHANDISING SYSTEM FOR USE WITH PERFORATED PANELS OR THE LIKE

BACKGROUND OF THE INVENTION

This invention relates to a merchandising system and, more particularly, to a merchandising system which enables packages to be hung from and displayed in front of a perforated panel (commonly referred to as a "Pegboard") or other perforated member such as a slotted channel which is attached to a wall. Conventionally, display packages are hung from rod-like hooks or hangers which are attached removably to and project outwardly a substantial distance from the panel or channel with each hook or hanger beng adapted to support a row of several packages.

Typical merchandising systems of this character are disclosed in Valiulis U.S. Pat. No. 3,912,084 and Barnes U.S. Pat. Nos. Des. - 237,142. While such merchandising systems enable displays to be arranged with great flexibility, the rod-like hooks and hangers frequently cause injury — and particularly eye and facial injury — to persons who are inspecting or walking by the display and become accidentally jabbed or snagged by the hooks and hangers.

SUMMARY OF THE INVENTION

The general aim of the present invention is to provide a new and improved display package merchandising system of the above character which possesses most of the advantages of prior systems but which completely avoids the need and expense of outwardly projecting hooks or hangers and completely eliminates personal injuries caused by such hooks and hangers.

A more detailed object is to achieve the foregoing by providing a merchandising system having display packages which are uniquely formed so as to enable one package to hang either directly or substantially directly from a perforated panel or channel and to enable each succeeding package to hang directly from and in front of the immediately preceding package so that a series of packages may be hung in a horizontal row without need of an outwardly projecting hook or hanger for supporting the packages.

Another object is to provide a display package having a display card with a novel attaching portion which enables the package to be hung from and in front of a package having a similar card and which enables yet another package to be hung from and in front of the one package.

The invention also resides in the novel manner by which the attaching portion is formed so as to enable the attaching portion to the incorporated into a conventional display card with very little cost and to enable the card to remain in a flat condition except when the card is being displayed.

A further object of the invention is to provide a unique bracket which facilitates hanging of the display packages from certain types of perforated panels.

These and other objects and advantages of the invention will become more apparent from the following detailed description when taken in conjunction with the accompanying drawings.

Detailed Description of the Preferred Embodiments

One embodiment of a merchandising system incorporating the unique features of the present invention is shown in FIGS. 1 to 5 and includes an upright perforated member or panel 15 which is conventionally known as a "Pegboard." Such a panel is formed with several vertically spaced and horizontally extending rows of circular perforations or holes 16 which usually receive either a "Pegboard" hook or a bracket for supporting such a hook. The aforementioned Valiulis patent discloses one manner by which a hook may be attached to a panel such as the panel 15.

Figure 1:
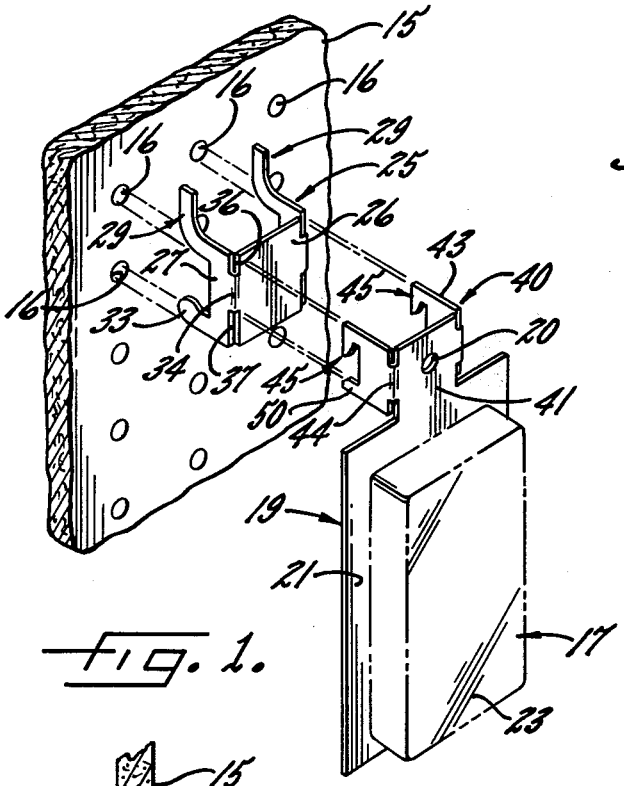
FIG. 1 is an exploded perspective view showing a typical perforated panel and further showing a unique display package and a unique bracket incorporating the novel features of the present invention.
Figure 2:
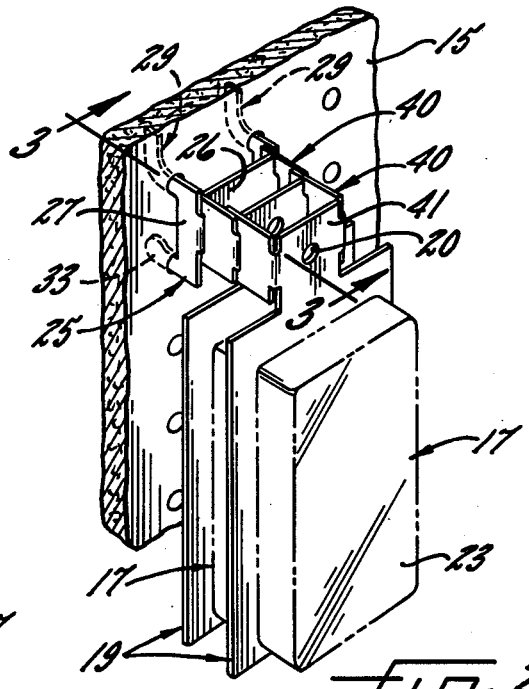
FIG. 2 is a perspective view showing the bracket attached to the panel, a first package hanging from the bracket and a second package hanging from the first package.
Figure 3:
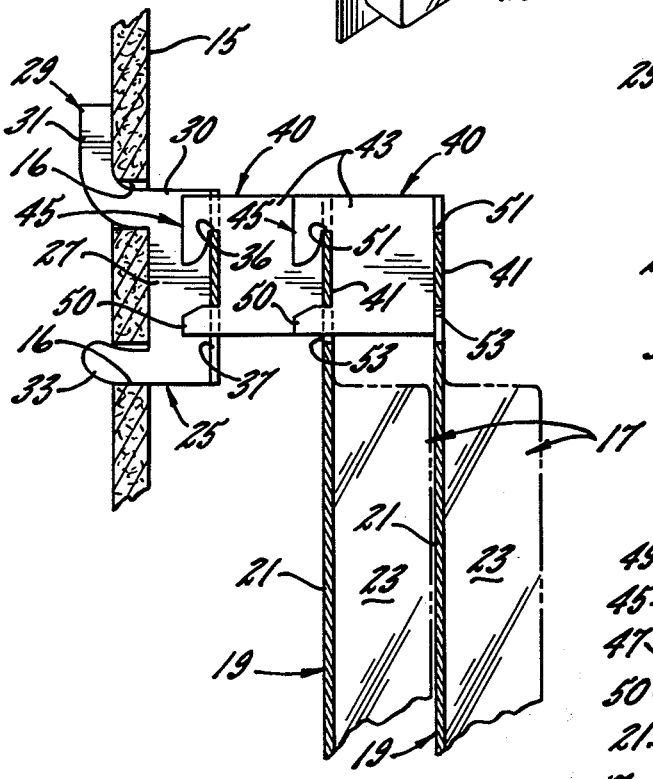
FIG. 3 is an enlarged fragmentary cross-section taken substantially along the line 3—3 of FIG. 2.
Figure 4:
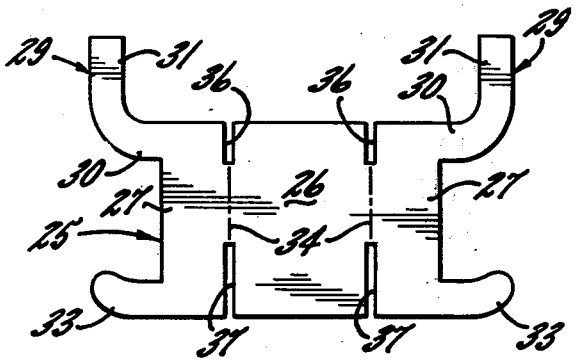
FIG. 4 is a front elevational view showing the bracket before the latter is attached to the panel.
Figure 5:
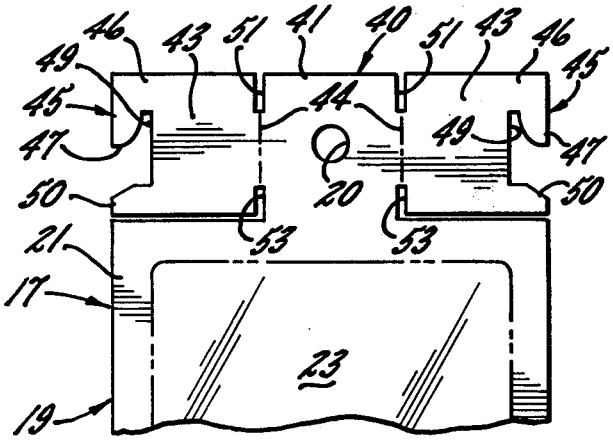
FIG. 5 is a fragmentary front elevational view showing one of the packages before the latter is attached to the panel.

Packages of merchandise may be displayed in various arrangements in front of the panel 15. An exemplary display package 17 is shown in FIG. 1 and includes a flat card 19 made of paperboard or other suitable material and formed with a hole 20 by which the package may be hung from a hook. The card includes a lower display portion 21 which may hold one or more articles of merchandise such as small articles of hardware. The merchandise may be held on the display portion of the card in various ways and is here shown as being contained within a bubble pack 23 which is formed on the front side of the display portion.

The present invention contemplates a novel merchandising system by which several display packages 17 may be hung in a horizontal row in front of a perforated member such as the panel 15 without need of hanging the packages from outwardly projecting hooks or the like. As a result, the cost of providing such hooks is completely eliminated and, even more importantly, there is no danger of a customer or passerby being jabbed, snagged or otherwise injured by the hooks. Thus, the present merchandising system eliminates the personal injuries resulting from hooks and yet enables the packages 17 to be displayed with virtually the same flexibility and convenience as is possible through the use of hooks.

When the packages 17 are to be displayed in front of a panel 15 having circular holes 16, it is advantageous to hang the first package from a part or member which may be easily attached to the panel and which herein is in the form of a bracket 25. The bracket preferably is of single-piece construction and is molded from a flat piece of relatively rigid plastic such as polypropylene. As molded, the bracket includes a central tab or plate 26 (FIG. 4) having a width approximately equal to the distance between two horizontally spaced holes 16 in the panel 15.

Joined to and formed integrally with each side of plate 26 is one side edge of a ear 27 having a length equal to the length of the plate. A hook or horn 29 is molded integrally with the opposite side edge of each ear adjacent the upper end thereof and includes a horizontally extending portion 30 projecting from the ear and a vertically extending portion 31 projecting upwardly from the horizontally extending portion. Formed integrally with and projecting horizontally from the lower end of each ear is a finger 33 which is spaced from the horizontal portion 30 of the horn 29 by a distance approximately equal to the distance between two vertically spaced holes 16 of the panel 15.

Each ear 27 preferably is connected to the plate 26 by a live hinge 34 (FIG. 4) located between adjacent side edges of the ear and the plate and formed by thinning a vertically extending section of the plastic during molding of the bracket 25. By virtue of the hinges, the ears can be swung rearwardly from and located at right angular positions relative to the plate (see FIG. 1) although it is possible to initially mold the ears in their right angular positions and to make the ears rigid with the plate.

In keeping with the invention, a perforation 36 (FIG. 4) is located between the plate 26 and each ear 27 adjacent the upper end thereof to enable a package 17 to be hung from the bracket 25. Preferably, a similar perforation 37 is located between the plate and each ear adjacent the lower end of the ear. In this instance, the upper and lower perforations 36 and 37 are in the form of upwardly opening and downwardly opening notches, respectively, and are formed during molding of the bracket by notching the plate 26 adjacent the upper and lower ends of the hinges 34 and at positions located just inboard of the hinges. Thus, the outboard wall of each notch 36, 37 is defined by the inboard edge of the adjacent ear 27 when the ear is disposed in the same plane as the plate 26 (see FIG. 4) and is defined by the inboard face of the ear when the latter is folded rearwardly relative to the plate (see FIG. 1).

To install the bracket 25 on the panel 15, the ears 27 are folded rearwardly about the hinges 34 and the bracket is turned to locate the plate 26 in a horizontal position with the ears projecting downwardly and with the ends of the horns 29 pointing toward the panel. By moving the plate edgewise, the normally vertical portions 31 of the horns may be inserted into two horizontally spaced holes 16 of one of the horizontally extending rows of holes formed in the panel. Thereafter, the plate 26 may be swung downwardly and toward the panel to cause the horizontal portions 30 of the horns 29 to enter the holes and to cause the vertical portions 31 to engage and interlock with the rear face of the panel just above the holes (see FIG. 3). As the plate is swung downwardly, the fingers 33 enter the two holes 16 in the next lower row and help support the bracket on the panel. When the bracket is installed on the panel, the ears 27 keep the plate 26 spaced forwardly from the front face of the panel.

An important aspect of the invention resides in providing the card 19 of each package 17 with a unique attaching portion 40 (FIG. 4) which enables the first card in a row to be hung from the bracket 25 and which enables the next card in the row to being hung directly from and in front of the first package and at the same elevation as the first package. In this way, each successive package of a row may hang from the immediately preceding package to enable the packages to be displayed in a forwardly extending row in substantially the same manner as if the packages were hung from a hook but without need of providing the hook.

More specifically, the attaching portion 40 of the package 17 of the preferred embodiment includes a tab 41 (FIG. 4) which is formed integrally with and which projects upwardly from the central region of the display portion 21 of the card 19. The hole 20 is formed in the tab to enable the package to be hung from a conventional hook if desired.

Located on each side of the tab 41 is an ear 43 (FIG. 4) which is joined to the tab by a live hinge 44 similar to the hinge 34 and formed by scoring the paperboard from which the card is made. The lower edge of each ear 43 is free of the upper edge of the display portion 21 of the card 19 so that the ear may be folded rearwardly relative to the tab 41 about the hinge 44 (see FIG. 1).

A hook 45 (FIG. 4) is located at the outboard edge of each ear 43 adjacent the upper end thereof and includes a horizontally extending portion 46 projecting outwardly from the ear and a vertically extending portion 47 extending downwardly from the horizontally extending portion and spaced outwardly from the ear, there thus being a notch 49 defined between the ear and the hook. In addition, the lower end of each ear is formed with a horizontally projecting finger 50.

Like the bracket 25, the attaching portion 40 of the card 19 is formed with a pair of upper perforations or notches 51 (FIG. 4) and a pair of lower perforations or notches 53. The tab 41 of the attaching portion 40 has the same width as the plate 26 of the bracket 25 and the notches 51 and 53 are located relative to the tab 41, the ears 43 and the hinges 44 in the same manner that the notches 36 and 37 are located relative to the plate 26, the ears 25 and the hinges 34 of the bracket 25. Thus, it will be seen that the attaching portion 40 of the card 19 is identical to the bracket 25 except that the vertically extending portions 47 of the hooks 45 project downwardly whereas the vertically extending portions 31 of the horns 29 project upwardly. Also, the ears 43 of the attaching portion 40 should have a width somewhat greater than the front-to-rear dimension of the bubble pack 23 or like article located on front of the card 19.

The tab 41, the ears 43, the hooks 45 and the fingers 50 are all die cut from the same flat stock from which the display portion 21 of the card 19 is made and thus the entire attaching portion 40 of the card initially is disposed in the same plane as the display portion 21. To hang the package 17 from the bracket 25, the ears 43 are folded rearwardly about the hinges 44 until the ears are disposed at right angles to the tab 41 (see FIGS. 1 to 3). Thereafter, the card 19 is positioned with the hooks 45 located above and alined with the upper notches 36 in the bracket 25 and then the card is shifted downwardly while being held in a position such that the lower end portion of the card is tilted slightly in a forward direction and away from the panel 15. As the card is shifted downwardly, the downwardly projecting portions 47 of the hooks 45 slip behind and engage the rear face of the plate 26 while the horizontally projecting portions 46 of the hooks slip downwardly within the notches 36 and then engage the bottoms thereof. The lower end portion of the card then is tilted rearwardly toward the panel and, as an incident thereto, the fingers 50 enter into the lower notches 37 of the bracket 25. The card 19 thus hangs from the bracket much in the same manner that the bracket hangs from the panel and may be removed from the bracket by reversely following the procedure described above.

The second display package 17 in the row has an attaching portion 41 which is identical to the first package and may be hung from the first package in the same manner that the first package is hung from the bracket 25. Thus, the hooks 45 and fingers 50 of the second package enter into the notches 51 and 53, respectively, of the first package so that the second package is supported by the first package. A third package may be hung from the second package, a fourth package may be hung from the third package and so on until either the weight of the packages and/or the length of the row makes it impractical to add further packages to the row. It should be noted that the upwardly facing surfaces defined by the bottoms of the notches 51 are located at the same elevation as the downwardly facing surfaces defined by the lower edges of the horizontal portions 46 of the hooks 45. Thus, each succeeding package 17 hangs at the same elevation as the immediately preceding package 17.

Figure 6:
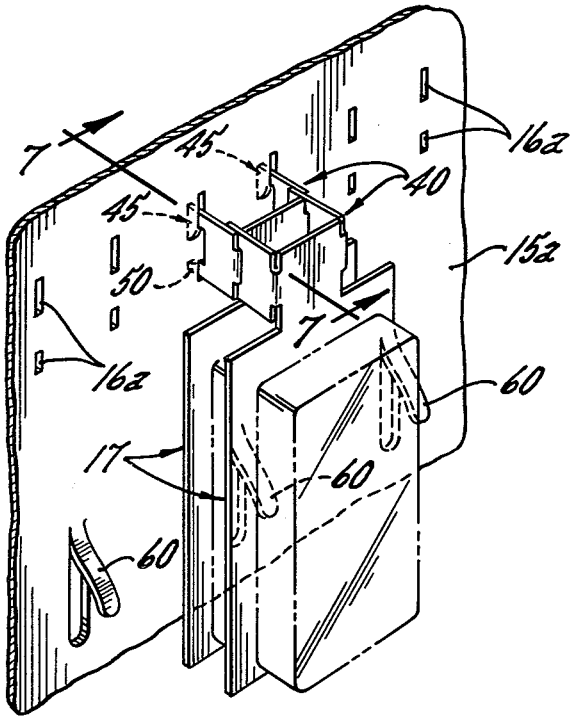
FIG. 6 is a perspective view somewhat similar to FIG. 2 but shows a modified panel.
Figure 7:
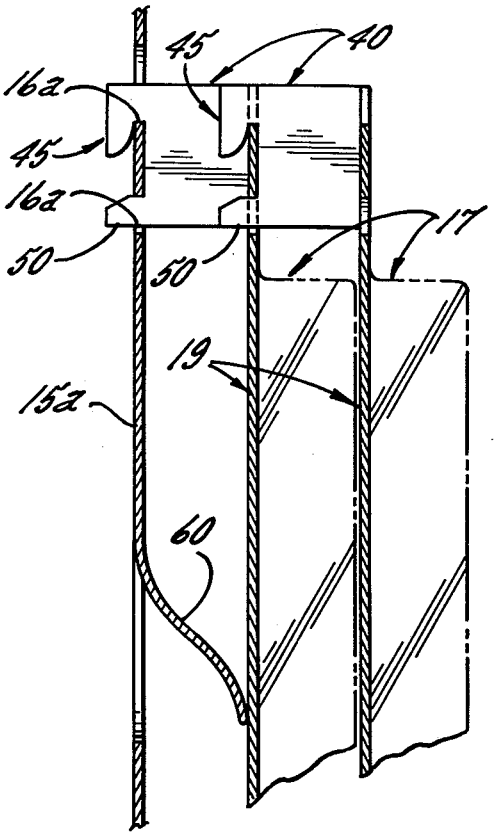
FIG. 7 is an enlarged fragmentary cross-section taken substantially along the line 7—7 of FIG. 6.

With certain types of perforated panels and other perforated members such as perforated channels or standards, it is not necessary to use the bracket 25 to hang the first package 17 but instead the first package may be hung directly from the perforated member itself. One such member is a metal panel indicated by the reference numeral **15*a* in FIGS. 6 and 7 and includes perforations in the form of vertically elongated slots 16*a*. With such a panel, the hooks 45 of the package may be inserted directly into an upper pair of slots while the fingers 50 of the package may be inserted into a lower pair of slots. Preferably, tabs 60 are struck out of the panel at predetermined locations and engage the rear side of the first package of each row to hold the package in forwardly spaced relation from the panel. 51'**

Figure 8:
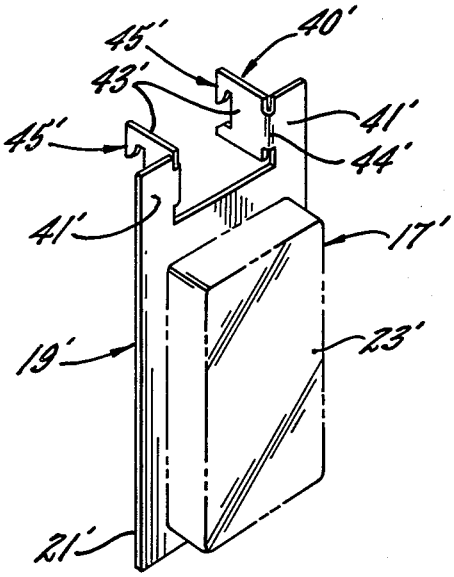
FIG. 8 is a perspective view of a modified package.
Figure 9:
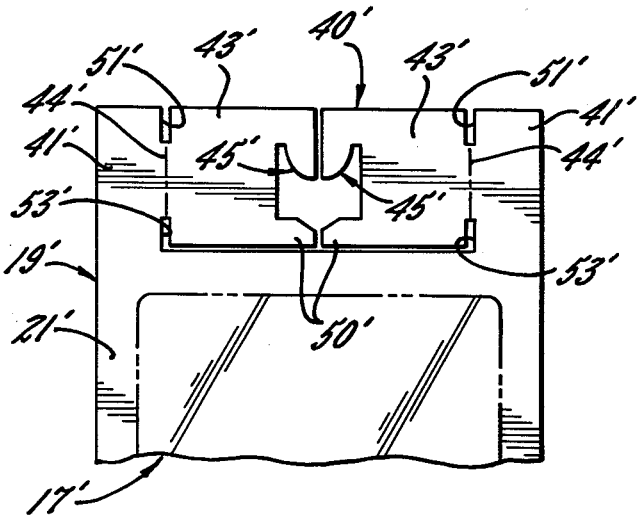
FIG. 9 is an enlarged fragmentary front elevational view of the package illustrated in FIG. 8 and shows the package before the latter is attached to the panel.

A package 17' with a modified attaching portion 40' is shown in FIGS. 8 and 9 in which parts corresponding to those of the first embodiment are indicated by the same but primed reference numerals. Rather than a single centrally located tab 41, the attaching portion 40' includes two tabs 41' which project upwardly from the display portion 21' of the card 19' adjacent opposite side edges thereof. The ears 43' are hinged at 44' to the inboard edges of the tabs 41' while the hooks 45' and the fingers 50' are formed on the inboard edges of the ears. Upper and lower notches 50' and 53' are formed between the tabs 41' and the ears 43' for receiving the hooks 45' and fingers 50', respectively, of the succeeding package 17'.

Figure 10:
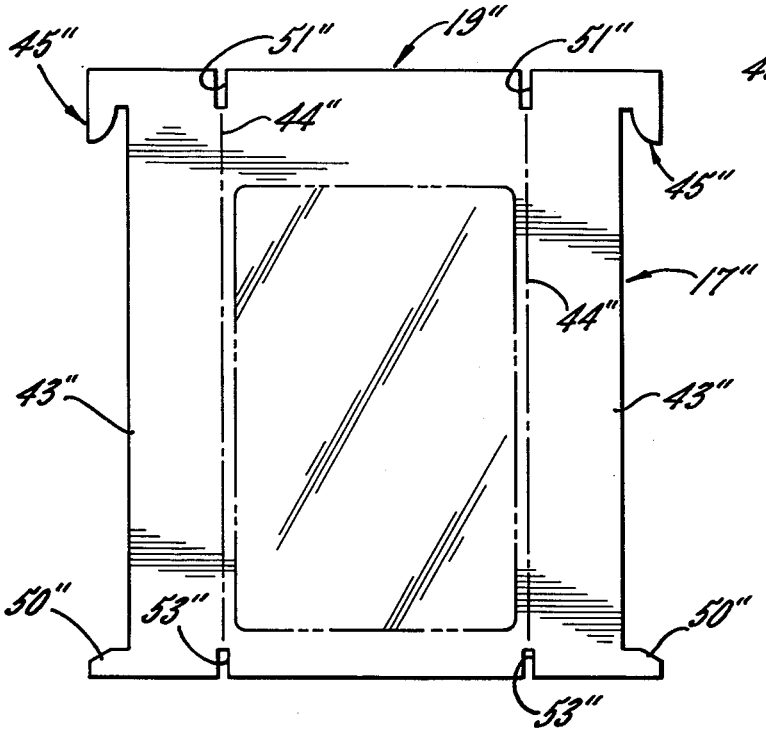
FIG. 10 is a front elevational view somewhat similar to FIG. 5 but shows still another package.
Figure 11:
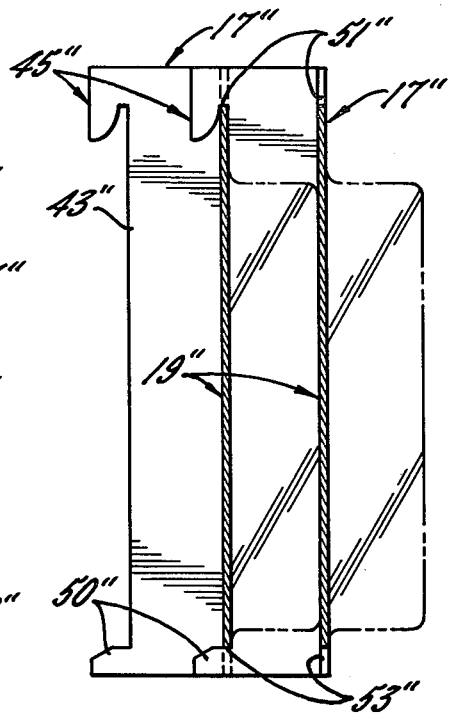
FIG. 11 is a cross-sectional view showing two interconnected packages of the type illustrated in FIG. 10.

Still another package 17'' incorporating the features of the invention is shown in FIG. 10 in which parts corresponding to those of the first embodiment are indicated by the same but double primed reference numerals. In the package 17'', ears 43'' extend along the full length of opposite side edges of the card 19'' and are joined to the card by hinges 44''. A hook 45'' is formed on the upper end of each ear while a finger 50'' projects from the lower end of each ear. Notches 51'' and 53'' are formed at the upper and lower ends, respectively, of the hinges 44'' and are adapted to receive the hooks 45'' and fingers 50'' of a succeeding package 17''. Thus, one package 17'' may be hung from another package 17'' as shown in FIG. 11.

Figure 12:
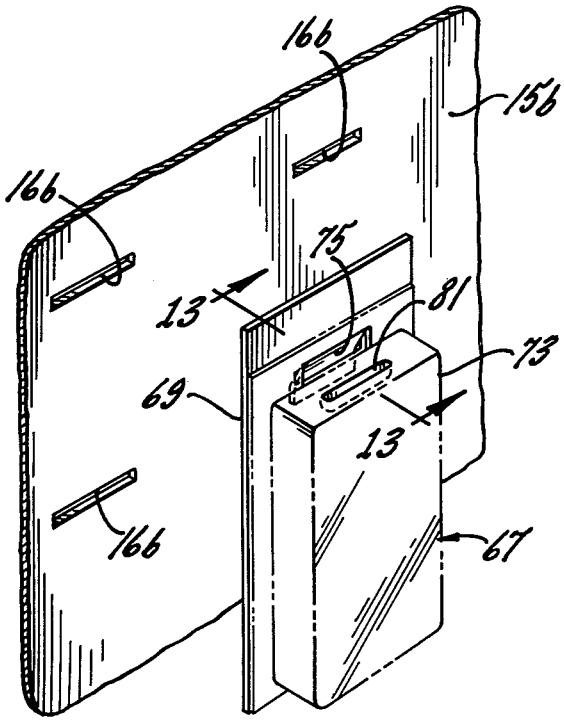
FIG. 12 is a perspective view showing yet another panel and yet another package.
Figure 13:
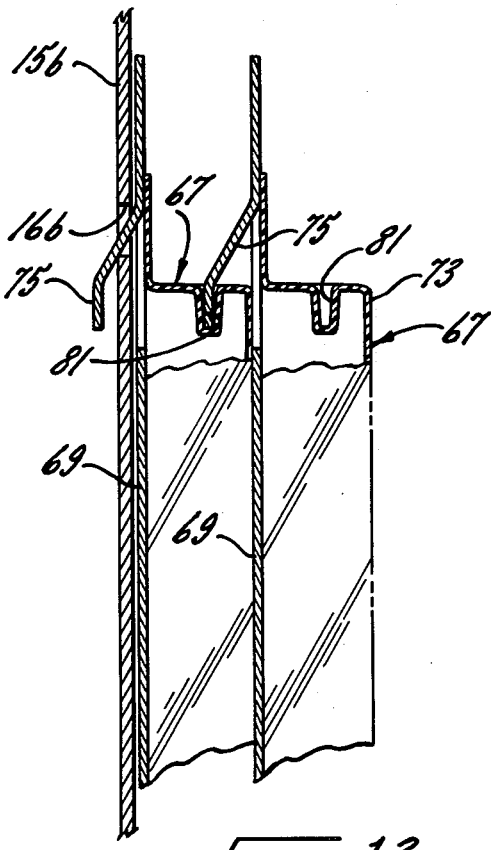
FIG. 13 is an enlarged fragmentary cross-section taken substantially along the line 13—13 of FIG. 12.

A modified package 67 is shown in FIG. 12 and is adapted for use with a panel **15*b* having elongated horizontal perforations or slots 16*b*. The package 67 includes a card 69 with a bubble pack 73 on the front side thereof. A downwardly and rearwardly projecting hook 75 is struck out of the card and is adapted to slip into one of the slots 16*b* in the panel 15*b* to enable a first one of the packages 67 to hang from the panel. To enable a second package to hang from the first package, a perforation 81 is formed in each package and is adapted to receive the hook 75 of a succeeding package. Herein, the perforation 81 is in the form of an upwardly opening pocket which is formed in the upper end of the bubble pack 73. By placing the hook 75 of a succeeding package 67 into the pocket 81 of a preceding package 67, the latter package may be hung from the former package as shown in FIG. 13. The upwardly facing surface defined by the bottom of the pocket 81 is located at the same level as the downwardly facing surface defined by the lower edge of the hook 75 and thus each of the packages 67** in a row will hang at the same elevation.

From the foregoing, it will be apparent that the present invention brings to the art a new and improved merchandising system which eliminates both the expense and danger of "Pegboard" hooks. With respect to the embodiments shown in FIGS. 1 to 9, the attaching portion 40, 40' of each card 19, 19' can be die-cut at the same time that the display portion 21, 21' of the card is formed and thus the attaching portion adds very little to the cost of the package. Also, the attaching portion remains flat until the card is hung from the panel **15, 15*a* and thus the attaching portion does not significantly increase the space occupied by the card during shipping. While the attaching portion 40, 40'** has been shown as forming the upper end portion of a card which holds merchandise, it should be realized that the attaching portion could be located on the upper end of a pouch or other container. Also, the attaching portion could be stapled or otherwise secured to a card or the like rather than being formed integrally with the card.

The ears 43'' of the package 17'' shown in FIG. 10 also may be die-cut at the same time the card 19'' is formed and also will remain flat until the card is hung from the panel. Because the ears extend the full length of the card, each of the packages 17'' is supported in a very stable manner.

The hook 75 and the pocket 81 of the package 67 shown in FIG. 12 may be formed in a relatively simple and inexpensive manner. Since the packages 67 require only a single hook, each package may be easily hung onto and released from a preceding package.

We claim:

1. A display package having a card for holding merchandise, said package having first means for hanging the package from and in front of an upright member and having second means enabling an identical display package to be hung from and in front of the first package at the same elevation as the first package, said first means comprising a pair of downwardly extending and laterally spaced hooks, hinges connecting said hooks to said card to swing rearwardly from a first position in which each hook is disposed in the same plane as said card to a second position in which each hook extends rearwardly from said card, and said second means comprising upwardly opening notches formed in said card at the upper ends of said hinges.

2. A display package as defined in claim 1 in which ears extend along substantially the full length of said card at opposite side edges thereof, said ears being joined swingably to said card by said hinges, and said hooks being located at the upper ends of said ears.

3. A display package as defined in claim 2 further including fingers joined to the lower ends of said ears and projecting rearwardly from said ears when said hooks are in said second position.

4. A display package comprising a card adapted to be supported in front of an upright member having spaced perforations, said card including a display portion adapted to hold merchandise and adapted to hang in a substantially vertical plane, said card further including an attaching portion located at the upper end of said display portion for connecting said card releasably to said member, said attaching portion comprising tab means joined to and projecting upwardly from said display portion and disposed in the same plane as said display portion, a pair of ears located alongside said tab means and each having a lower edge which is free of said display portion, a hook formed integrally with and projecting from one side edge of each of said ears adjacent the upper end thereof and adapted to be inserted into one of said perforations, each of said hooks being disposed in the same plane as its respective ear, a hinge joining the opposite side edge of each ear to said tab means and supporting said ear to swing from a first position in which the ear is disposed in the same plane as said tab means and a second position in which the ear projects rearwardly from said tab means to enable said hook to enter one of said perforations, and perforations defined at the upper ends of said hinges and located between said ears and said tab means to receive the hooks of a similar display package and enable that package to hang from said attaching portion.

5. A display package as defined in claim 4 further including a finger formed integrally with and projecting from said one side edge of each of said ears adjacent the lower end thereof and adapted to be inserted into one of said perforations of said member, and additional perforations defined at the lower ends of said hinges and located between said ears and said tab means to receive the fingers of said similar package.

6. A display package as defined in claim 4 in which said tab means comprises a tab projecting upwardly from the central region of said display portion, said ears beng hinged to the side edges of said tab, and said hooks being formed integrally with the outboard edges of said ears.

7. A display package as defined in claim 4 in which said tab means comprises two horizontally spaced tabs projecting upwardly from the outboard margins of said display portion, said ears being located between said tabs with one of said ears being hinged to the inboard edge of one of said tabs and with the other of said ears being hinged to the inboard edge of the other of said tabs, and said hooks being formed integrally with the inboard edges of said ears.

8. A display package as defined in claim 4 in which each of said hooks includes a portion projecting horizontally from said one side edge of said ear and further includes a portion projecting downwardly from said horizontally projecting portion, there being a notch defined between each downwardly projecting portion and the adjacent side edge of the associated ear.

9. A system for displaying merchandise in front of an upright panel having two horizontally spaced upper perforations and having two horizontally spaced lower perforations alined vertically with said upper perforations, said system comprising a bracket having an upright plate, ears projecting rearwardly from opposite side edges of said plate and each having one edge joined integrally with said plate, a hook extending rearwardly and vertically from the opposite edge of each ear adjacent the upper end thereof with said hooks beng adapted for insertion into said upper perforations, a finger extending rearwardly from said opposite side edge of each ear adjacent the lower end thereof with said fingers being adapted for insertion into said lower perforations, an upper pair of horizontally spaced notches defined between said plate and said ears adjacent the upper ends thereof, and a lower pair of horizontally spaced notches defined between said plate and said ears adjacent the lower ends thereof, said system further comprising a card having a display portion adapted to hold merchandise and adapted to hang in a substantially vertical plane, said card further including an attaching portion located at the upper end of said display portion for connecting said card releasably to said bracket, said attaching portion comprising tab means joined to and projecting upwardly from said display portion and disposed in the same plane as said display portion, a pair of ears located alongside said tab means and each having a lower edge which is free of said display portion, a hook formed integrally with and projecting from one side edge of each of the ears of the attaching portion adjacent the upper end thereof with the hooks of said attaching portion being adapted for insertion into the upper notches of said bracket, a finger formed integrally with and projecting from said one side edge of each of the ears of said attaching portion with the fingers of said attaching portion being adapted for insertion into the lower notches of said bracket, each of said hooks and fingers of said attaching portion being disposed in the same plane as their respective ears, a hinge joining the opposite side edge of each ear of said attaching portion to said tab means and supporting such ear to swing from a first position in which the ear is disposed in the same plane as said tab means and a second position in which the ear projects rearwardly from said tab means to enable said hooks and fingers of said attaching portion to enter the notches of said bracket, and notches defined at the upper and lower ends of said hinges and located between said tab means and said ears of said attaching portion to receive the hooks and fingers of a similar card and enable that card to hang from said attaching portion.

10. A part for supporting a display package in front of an upright member having spaced perforations, said display package having two rearwardly extending and horizontally spaced hooks, said part comprising upright tab means, a pair of horizontally spaced ears projecting rearwardly from said tab means and each having one side edge joined to said tab means, a hook extending rearwardly from the opposite edge of each of said ears and adapted to be inserted into one of said perforations, and horizontally spaced perforations defined between said tab means and said ears adjacent the upper ends thereof for receiving the hooks of said display package.

11. A part as defined in claim 10 in which said ears are formed integrally with said tab means, and an upright hinge joining said one side edge of each ear to said tab means and supporting said ear to swing from a first position in which the ear is disposed in the same plane as the tab means and a second position in which the ear projects rearwardly from the tab means.

12. A part as defined in claim 11 in which said tab means is a plate, said hinges being located at opposite side edges of said plate, and said perforations between said tab means and said ears being located at the upper ends of said hinges.

13. A part as defined in claim 10 in which each of said hooks includes a portion extending substantially horizontally from the respective ear and further includes a portion extending upwardly from said horizontally extending portion.

14. A part as defined in claim 10 in which said hooks extend rearwardly from the upper ends of said ears, said part further including fingers extending rearwardly from the lower ends of said ears and each adapted to be inserted into one of said perforations of said member.

15. A part as defined in claim 10 further including additional horizontally spaced perforations defined between said tab means and said ears adjacent the lower ends thereof.

16. A part as defined in claim 10 for supporting a display package comprising a card adapted to hold merchandise, said part being formed integrally with the upper end of said card.

* * * * *